US010160569B2

(12) United States Patent
Diep et al.

(10) Patent No.: US 10,160,569 B2
(45) Date of Patent: Dec. 25, 2018

(54) VARIABLE HEIGHT NESTED CONTAINERS BASED ON ROTATIONAL ORIENTATION

(71) Applicant: Amazon Technologies, Inc., Seattle, WA (US)

(72) Inventors: George Diep, Cambridge, MA (US); Christopher Albert Park, Medford, MA (US); Curtis H. Nauseda, Maynard, MA (US)

(73) Assignee: Amazon Technologies, Inc., Seattle, WA (US)

( * ) Notice: Subject to any disclaimer, the term of this patent is extended or adjusted under 35 U.S.C. 154(b) by 140 days.

(21) Appl. No.: 15/081,502

(22) Filed: Mar. 25, 2016

(65) Prior Publication Data

US 2018/0265252 A1 Sep. 20, 2018

(51) Int. Cl.
*B65D 21/032* (2006.01)
*B65D 21/02* (2006.01)
*B65G 57/16* (2006.01)

(52) U.S. Cl.
CPC ..... *B65D 21/0233* (2013.01); *B65G 57/165* (2013.01)

(58) Field of Classification Search
CPC ..... B65D 21/0233; B65D 21/046; B65D 21/045; B65D 21/043; B65D 21/041; B65D 21/0209; B65D 21/0216; B65D 21/0212; B65G 57/165
USPC ..... 206/507
See application file for complete search history.

(56) References Cited

U.S. PATENT DOCUMENTS

| | | | | |
|---|---|---|---|---|
| 4,139,098 A * | 2/1979 | Mollon | B65D 21/046 206/507 |
| 5,609,254 A * | 3/1997 | Loftus | B65D 21/041 206/506 |
| 5,881,902 A * | 3/1999 | Ackermann | B65D 21/041 206/507 |
| 2012/0073248 A1* | 3/2012 | Stahl | B65D 21/0233 53/473 |
| 2012/0241350 A1* | 9/2012 | Stahl | B65D 21/0212 206/509 |

* cited by examiner

*Primary Examiner* — Stephen Castellano
(74) *Attorney, Agent, or Firm* — Kilpatrick Townsend & Stockton LLP

(57) ABSTRACT

Disclosed are containers that can nest with one another at different heights between the containers based on a relative orientation in which the containers are brought into nesting engagement. Support features (e.g., arranged about an interior of a receiving container and/or about an exterior of a received container) may interact with one another differently based on the particular orientation (e.g., rotational alignment) in which the containers are brought together, which can cause the containers to be supported at different heights relative to one another.

20 Claims, 11 Drawing Sheets

VARIABLE HEIGHT NESTED CONTAINERS BASED ON ROTATIONAL ORIENTATION

BACKGROUND

Modern manufacturing, assembly, and storage systems face significant challenges in receiving, storing, and managing items. One significant challenge is effective utilization of space for storing, transporting, or otherwise handling items. Inefficient use of space may lead to larger amounts of space being used to facilitate operations, leading to greater costs or limitations due to lack of available space. In many cases, standardized containers for receiving items may be used to reduce an infrastructure cost. However, use of standardized containers may also result in inefficient use of space. For example, a standardized container having a height of one foot may be useful for receiving items up to one foot in height, but when smaller items are stored in such a standardized container, the container may include significant amounts of unused space and therefore result in underutilized and/or wasted space. At the same time, providing a wide range of differently sized containers to accommodate each different size of item and thereby minimize wasted space can be economically infeasible. Accordingly, for at least these reasons, effective or efficient use of storage space in manufacturing, assembly, and storage systems (or other systems that utilize containers) remains an existing concern in many scenarios.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments herein are directed to containers. The containers can nest one within another. For a pair of containers nested together, one container may be the receiving or base container and the other container may be the received container. When nested, the received container is positioned and/or supported at least partially within the base container. Support features may be provided that permit a received container to nest within a base container at a certain height when the containers are arranged in a first alignment and at another height when arranged in a second alignment. In some cases, the support features permit nesting at additional heights when the containers are arranged in additional alignments. The different alignments may correspond to different rotational orientations of the containers relative to one another. The support features may be arranged along the interior of the base container and/or along the exterior of the received container. Such functionality of providing a variable height between nested containers based on the alignment of the nested containers can allow a space between containers to be varied, for example, in order to accommodate items (e.g., inventory items) of different sizes. Varying the height between the containers by nesting at different orientations may thus reduce or eliminate space that might otherwise be underutilized or wasted between or within the nested containers.

Figure 1:
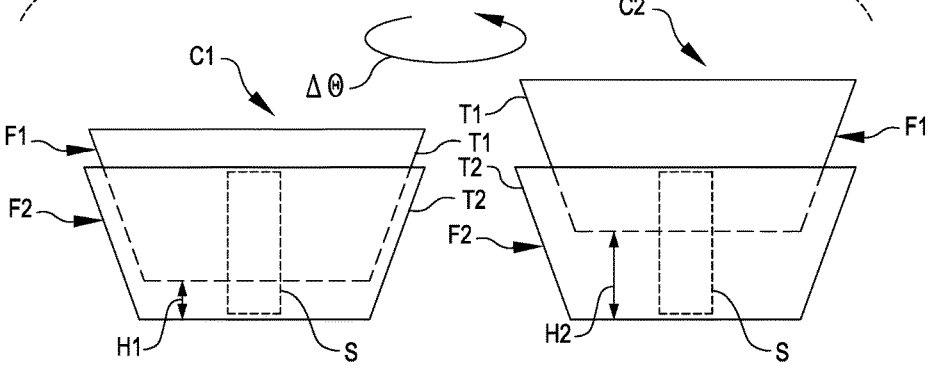
FIG. 1 is a schematic illustration showing multiple configurations of a set of containers that can be nested with different heights between the containers based on the relative rotational alignment of the containers according to certain embodiments.

Referring now to the figures, FIG. 1 illustrates a first container T1 that can nest within a second container T2 at different heights H1 and H2 in different configurations C1 and C2. In some embodiments, the containers T1 and T2 may correspond to standardized plastic containers having four walls (commonly referred to as totes). The containers T1 and T2, however, may be made of any suitable material or material combination (including, e.g., plastic, cardboard, metal, foam, or wood) and may include any suitable number of sidewalls (including, e.g., three, four, or more than four).

The containers T1 and T2 may be formed having sidewalls connected with a bottom so as to form a body of the container T1 and T2 that is open at a top, e.g., such that items may be placed into the container T1 and T2 through the top.

For ease of reference, terms such as up, upward, or upper may be used herein to refer to a relative orientation that is closer to the top end of the container, while terms such as down, downward, or lower may be used to refer to a relative orientation that is closer to the bottom of the container. The sidewalls may be oriented at least partially flared or tapered away from the bottom, such as to provide a sufficient draft angle of the walls to permit the first container T1 to be received within the second container T2 or vice versa.

The sidewalls can be arranged relative to one another such that a cross-sectional shape (e.g., a horizontal cross-sectional shape) of each container T1 and T2 corresponds to a polygon. For example, when viewed from above or below, the containers T1 and T2 may resemble a triangle, a quadrilateral (such as a square, a rectangle, a rhombus, etc.), a pentagon, a hexagon, or another polygon. The polygon may be a regular polygon, such that all sides of the polygon are equal or approximately equal in length. In various embodiments, the sidewalls of each container T1 and T2 may each extend along each other and along a side of the polygon when the containers T1 and T2 are nested together.

The first container T1 has a reference face F1, and the second container T2 similarly has a reference face F2. Each reference face may represent a sidewall or other identifiable feature of the respective container T1 or T2.

In the first configuration C1 (shown at left in FIG. 1), the reference face F1 of the first container T1 is positioned in a first alignment (e.g., adjacent or abutting) with respect to the reference face F2 of the second container T2. Support features S position the first container T1 and the second container T2 a first height H1 apart from one another in the first configuration C1.

The support features S are shown schematically by the dashed outline in FIG. 1. Several examples of the support features S are described in greater detail below with respect to other figures herein. Generally, the support features may include any suitable structural features that can support the first container T1 when in a nested configuration within the second container T2. The support features S may be positioned along the exterior of the first container T1, along the interior of the second container T2, or a combination thereof.

The first container T1 may be shifted away from the first configuration C1, for example, to facilitate a shift to the second configuration C2 (shown at right in FIG. 1). In various embodiments, this shift may include a relative rotation (e.g., as illustrated by arrow $\Delta\theta$) between the first container T1 and the second container T2, such as by rotating the first container T1 in one direction and/or rotating the second container T2 in an opposite direction. Such a rotation or other shift can move the reference face F1 of the first container into a different alignment with respect to the reference face F2 of the second container T2. This change in alignment may cause the support features S to engage in such a manner that the first container T1 is supported at a second height H2 in the second configuration C2 that is higher or otherwise different than the first height H1 between the containers in the first configuration C1.

Accordingly, in operation, a user may select the rotational alignment (or other relative alignment) between the first container T1 and the second container T2 in order to determine a height H1 or H2 between the two different containers. Although FIG. 1 only shows a first configuration C1 and a second configuration C2, the containers T1 and T2 in some embodiments may be provided with sufficient support features S to allow more configurations and corresponding additional heights between the two containers T1 and T2. As an illustrative example, the containers T1 and T2 depicted in FIG. 1 may correspond to four-sided containers such that the relative rotation illustrated by arrow $\Delta\theta$ corresponds to a 180° turn. In such an arrangement, the support features S may additionally permit additional different heights from the heights H1 and H2 by rotations of 90° or 270° away from the first configuration C1. In another illustrative example, the containers T1 and T2 depicted in FIG. 1 may correspond to three-sided containers such that the relative rotation illustrated by arrow $\Delta\theta$ corresponds to a 240° turn. In such an arrangement, the support features S may additionally permit another different height from the heights H1 and H2 by a rotation of 120° away from the first configuration C1. Other arrangements are also possible, and in many cases, the pair of containers T1 and T2 may provide up to a number of heights equal to a number of sides included in each container.

In some embodiments, the containers T1 and T2 may be replicas of one another. Such an arrangement may allow either container T1 or T2 to be nested within the other container T1 or T2. Additionally, in some embodiments, further similar or related containers may be provided, e.g., for further nesting functionality. For example, additional containers may be provided that can be nested within the first container T1 and/or receive the second container T2 for nesting, e.g., such that the first container T1 and the second container T2 may form part of a stack of containers that may be separated from one another by variable and/or varied heights, such as to minimize wasted space among the stacked containers. As another example, a third container may be provided that differs sufficiently from the first container T1 such that support features S will support the third container within the second container T2 at a different set of heights than those provided by altering the nested alignment of the first container T1 within the second container T2.

Many different containers may be examples of the containers T1 and/or T2 described in FIG. 1. Various examples are described in greater detail herein.

Figure 2:
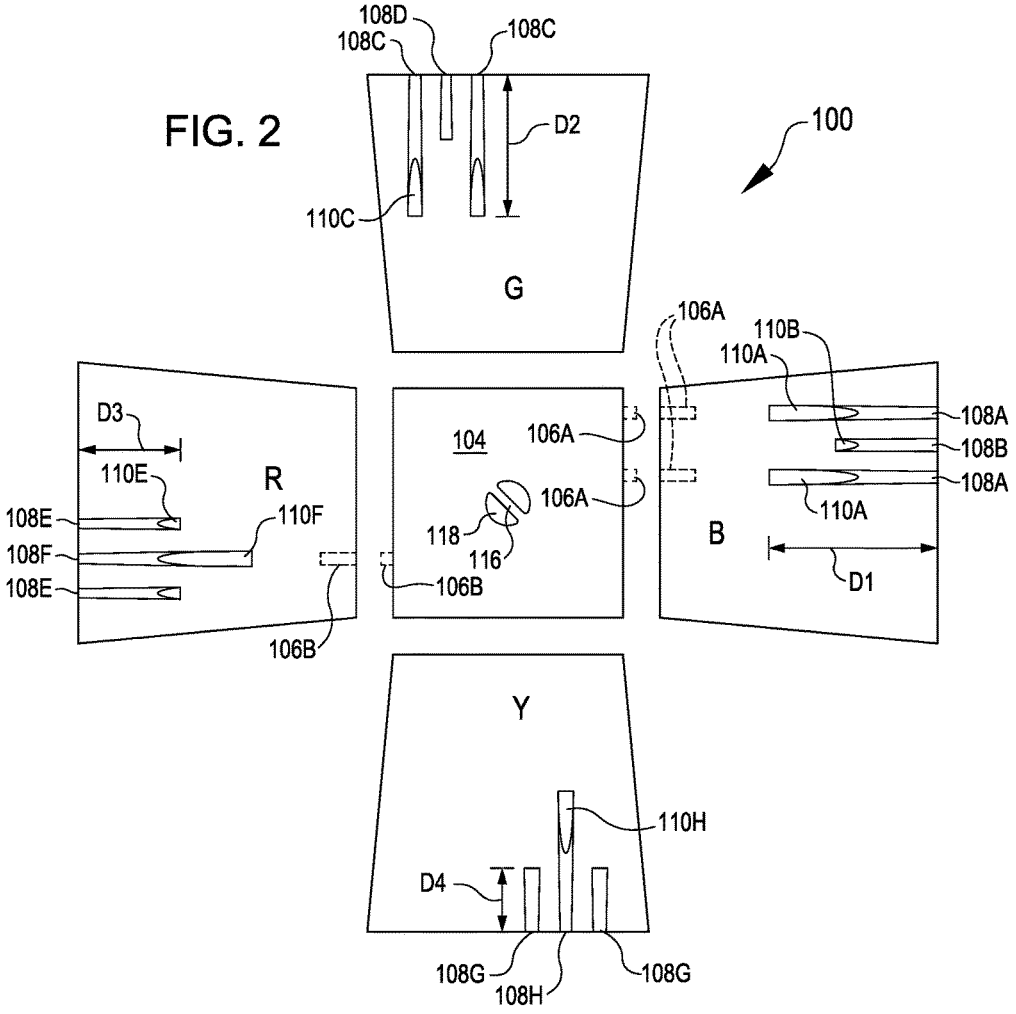
FIG. 2 illustrates one example of a container for variable height nesting, showing the walls of the container arranged in a laid-flat state according to certain embodiments.
Figure 3:
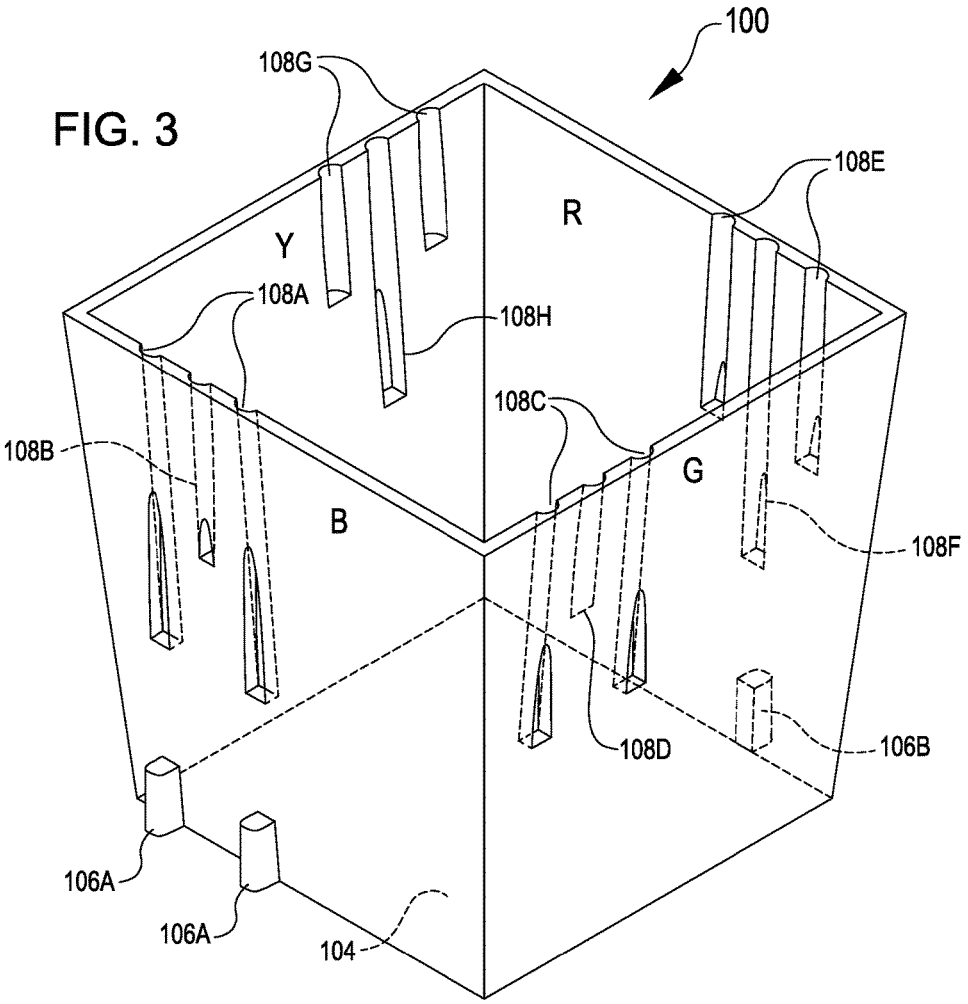
FIG. 3 illustrates a perspective view of the container of FIG. 2 in an assembled state.

FIGS. 2 and 3 illustrate one example of a container 100 that may provide nesting at multiple heights. The container 100 includes four walls respectively labeled R, G, B, and Y in the drawings. In some embodiments, the walls may be color coded (e.g., with R corresponding to red, G corresponding to green, B corresponding to blue, and Y corresponding to yellow, etc.), for example, to facilitate ease of identification of a particular wall by users of the container 100. For ease of reference, the four walls of the container 100 will be described herein as the red wall R, the green wall G, the blue wall B, and the yellow wall Y. However, any other set of colors and/or any other identification scheme, including e.g., letters, numbers, textures, and/or other symbols, may additionally or alternatively be used in practice.

The walls are connected with a bottom 104 to form a body of the container 100. Referring to FIG. 3, the walls may be joined together so as to form an open top end of the container 100, e.g., located opposite the bottom 104. Referring to FIG. 2, the illustrated walls are tapered away from the bottom 104 a sufficient amount to permit one container 100 to be nested within another through the open top.

The walls include examples of the support features S from FIG. 1, which allow the container 100 to nest at different heights. In FIGS. 2-3, these features S include pegs 106 (e.g., 106A, 106B, etc.) and notches 108 (e.g., 108A, 108B, etc.). In the illustrated embodiment, one wall (the blue wall B) includes a pair of pegs 106A, while another wall (in this case, the opposite wall, the red wall R) includes a single peg 106B. Each of these pegs 106 is shown positioned at a lower edge of the respective wall bearing the peg 106. In some embodiments, these pegs 106 may additionally or alternatively extend from the bottom 104, such as indicated in phantom line in FIG. 2.

The notches 108 can be arranged to receive the pegs 106. For example, some of the notches 108 (e.g., notches 108A, 108C, 108E, and 108G) are shown grouped in pairs for receiving the pair of pegs 106A, while others of the notches 108 (e.g., notches 108B, 108D, 108F, and 108H) are shown as individual notches for receiving the single peg 106B.

In operation, the pegs 106 can be sized to be received in the notches 108. This may facilitate the container 100 being received in a nesting arrangement with a replica of the container 100 (or with another container having similar notches 108). The pegs 106 can be alternatively received in different notches 108 to cause the container 100 to be nested at different heights. To this end, the notches 108 may extend different lengths along the respective walls. For example, in the arrangement shown in FIG. 2, the pair of notches 108A on the blue wall B and the single notch 108F on the red wall R extend a first length D1 from a top of the container 100, the notches 108C and 108H extend a different, shorter distance D2, the notches 108E and 108B extend an even shorter distance D3, and the notches 108G and 108D extend a shortest distance D4 of all the notches 108.

The notches 108 may be aligned substantially vertically, for example, to permit the pegs to slide down the notches 108 within the tapered walls. In some aspects, the notches 108 may extend sufficiently deep into a tapered wall of the container 100 so as to form through-holes 110 (e.g., through-holes 110A, 110C, etc.) through the container 100 that are visible from inside and outside of the container 100. However, in some embodiments, such through-holes 110 may not be present if the container walls are sufficiently thick.

FIGS. 4-7 illustrate different example nesting heights (e.g., H4 in FIG. 4, H5 in FIG. 5, H6 in FIG. 6, and H7 in FIG. 7) that can be achieved with the container 100. Each of FIGS. 4-7 show multiple instances or replicas of the container 100, respectively referenced as a bottom or first container 100-1 and a top or second container 100-2. Walls of the bottom container 100-1 are identified with the suffix "1" (e.g., R1, B1, Y1, G1), while walls of the top container are identified with the suffix "2" (e.g., R2, B2). In addition to causing the containers to nest at different heights, in each of FIGS. 4-7, the notches 108 and pegs 106 engage so that the tops of the nested containers are parallel or approximately parallel to one another. While this may be useful for stacking purposes, in some embodiments, other orientations of the tops of the containers other than parallel may be utilized.

Figure 4:
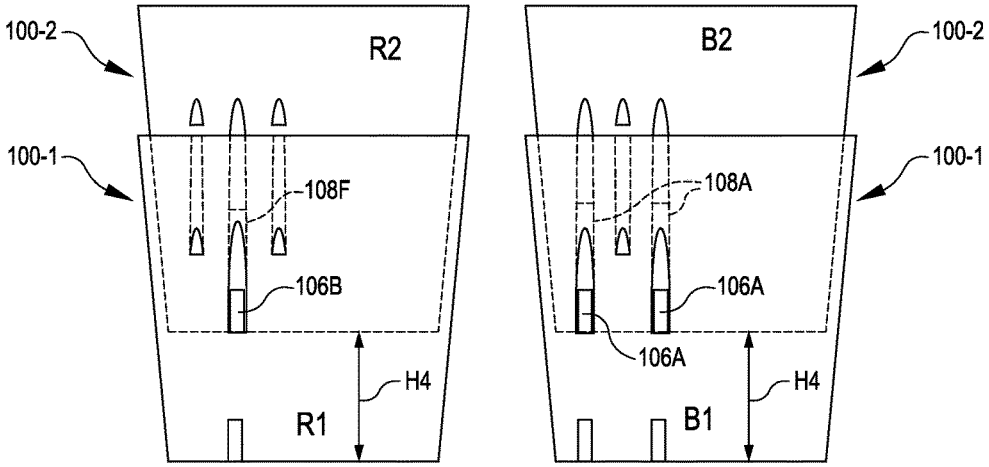
FIG. 4 illustrates a front view and a rear view of first and second instances of the container of FIGS. 2 and 3 in a first nested configuration providing one height between the containers.

In the configuration shown in FIG. 4, on one side of the containers (e.g., as shown at left of FIG. 4), the individual peg 106B of the red wall R2 of the top container 100-2 is received and supported at the bottom of the single notch 108F in the red wall R1 of the bottom container 100-1. On a reverse side (e.g., as shown at right in FIG. 4), the pair of pegs 106A of the blue wall B2 on the top container 100-2 are received at the bottom of the pair of notches 108A in the blue wall B1 of the bottom container 100-1. With the containers 100-1 and 100-2 so supported, a height H4 is provided between the container bottoms.

The top container 100-2 may be shifted out of the configuration depicted in FIG. 4 and rotated relative to the bottom container 100-1 to change the orientation of the walls of the containers and support the top container 100-2 at a different height. The rotation can correspond to a certain amount of rotation relative to the arrangement shown in FIG. 4. Thus, for ease of reference, the arrangement shown in FIG. 4 will be referred to as a "zero degree" orientation, from which the alignments of FIGS. 5-7 may be reckoned.

Figure 5:
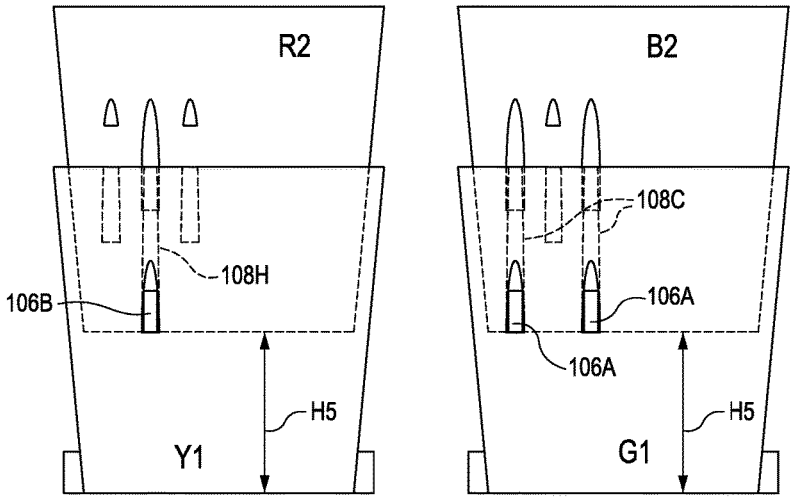
FIG. 5 illustrates a front view and a rear view of the pair of the containers of FIG. 4 in a second nested configuration providing a second height between the pair of containers.

FIG. 5 illustrates one configuration that may achieved by rotating the top container 100-2 away from the configuration shown in FIG. 4. For example, the change between FIG. 4 and FIG. 5 may correspond to a 90 degree counter-clockwise turn (or a 270 degree clockwise turn). In the configuration shown in FIG. 5, on one side of the containers (e.g., as shown at left of FIG. 5), the single peg 106B of the top container 100-2 can be received at the bottom of the notch 108H in the yellow wall Y1 of the bottom container 100-1. Correspondingly, on an opposite side of the containers (e.g., as shown at right in FIG. 5), the pair of pegs 106A of the top container 100-2 can be received at the bottom of the pair of notches 108C on the green wall G1 of the bottom container 100-1. The top container 100-2 can be rotated into or out of this configuration into other configurations shown herein. The FIG. 5 configuration may result in a height H5 between the top and bottom containers that is different from the other heights shown herein.

Figure 6:
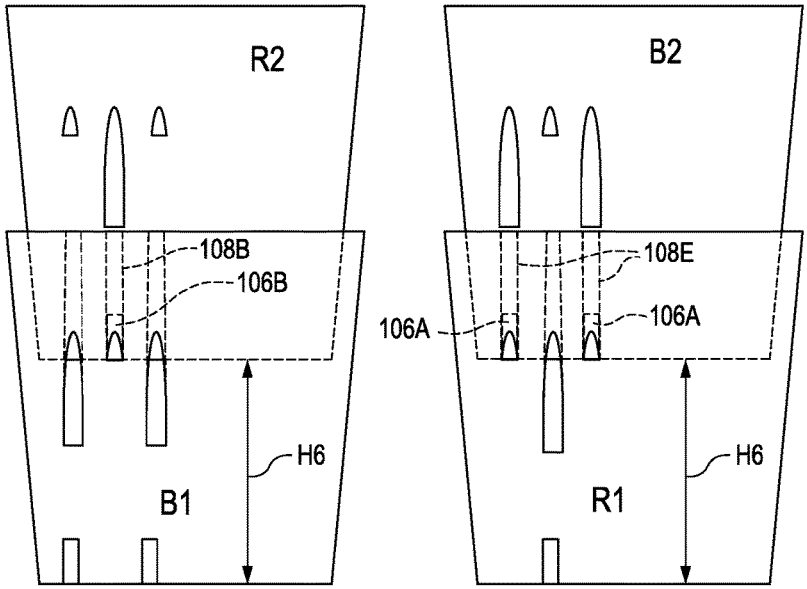
FIG. 6 illustrates a front view and a rear view of the pair of the containers of FIG. 4 in a third nested configuration providing a third height between the pair of containers.

FIG. 6 illustrates another configuration into which the containers can be arranged for another height H6 of nesting. FIG. 6 may correspond to a 180 degree turn from the zero degree orientation of FIG. 4. In the configuration shown in FIG. 6, on one side (e.g., shown at left in FIG. 6) the single peg 106B on the top container 100-2 is received in the notch 108B of the blue wall B1 of the bottom container 100-1. On an opposite side (e.g., shown at right in FIG. 6), the pair of pegs 106A are received in the pair of notches 108E on the red wall R1 of the bottom container 100-1.

Figure 7:
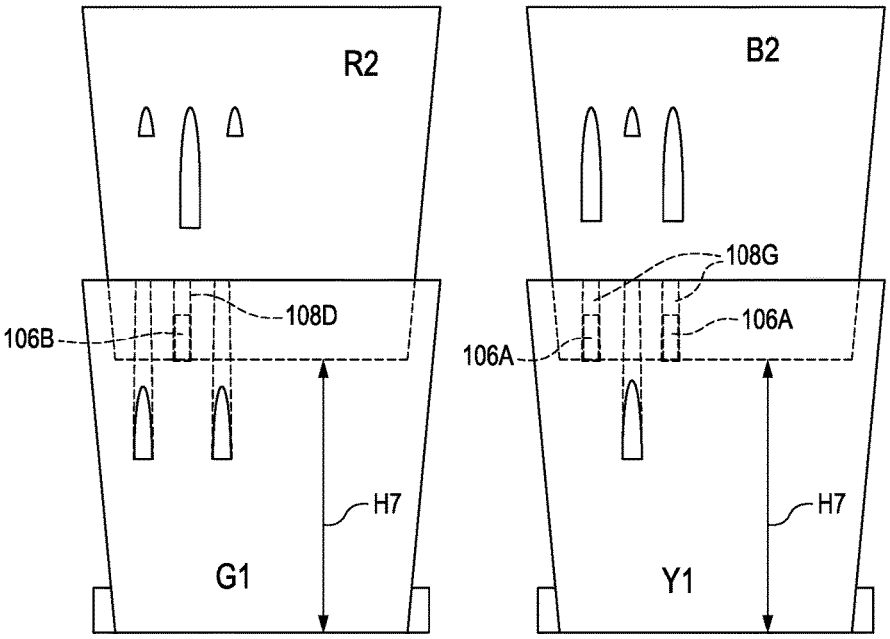
FIG. 7 illustrates a front view and a rear view of the pair of the containers of FIG. 4 in a fourth nested configuration providing a fourth height between the pair of containers.

FIG. 7 illustrates a fourth configuration for the containers. FIG. 7 may correspond to a 270 degree counter-clockwise turn (or a 90 degree clockwise turn) from the zero degree orientation of FIG. 4. In this configuration, on one side (e.g., at left in FIG. 7) the single peg 106B of the top container 100-2 is received in the single notch 108D of the green wall G1 of the bottom container 100-1. On an opposite side (e.g., at right in FIG. 7), the pair of pegs 106A is supported in the bottom of the pair of notches 108G of the yellow wall Y1 of the bottom container. This arrangement provides the height H7, which is the greatest of the four heights shown in FIGS. 4-7.

Although the containers 100-1 and 100-2 provide four different heights shown in FIGS. 4-7, the containers 100 may additionally or alternatively provide a different number of heights that is not equal to the number of sidewalls of each container 100. In one illustrative example, a set of notches (e.g., the shortest notches 108D and 108G on the container 100 in FIGS. 2-3) could be omitted such that the illustrated container 100 having four sidewalls R, G, B, and Y would provide three different nesting heights instead of four (e.g., eliminating the shortest notches 108D and 108G could eliminate the nesting height corresponding to D4 in FIG. 2 such that the container 100 would have just the nesting heights corresponding to D1, D2, and D3 in FIG. 2). Additionally or alternatively, a set of notches (e.g., the shortest notches 108D and 108G on the container 100 in FIGS. 2-3) could be arranged to match a length of another set of notches (e.g., the longest notches 108A and 108F) so that multiple sets of notches correspond to a common height (e.g., changing the shortest notches 108D and 108G to the length D1 could eliminate the nesting height corresponding to D4 in FIG. 2 such that the container 100 would have just the nesting heights corresponding to D1, D2, and D3 in FIG. 2, with the nesting height corresponding to D1 being available in two different orientations). In another illustrative example, pegs 106, bottoms of the notches 108, and/or other features of the container may be removable, retractable, extendible, or otherwise adjustable, e.g., so that other heights may also be obtained.

Figure 8:
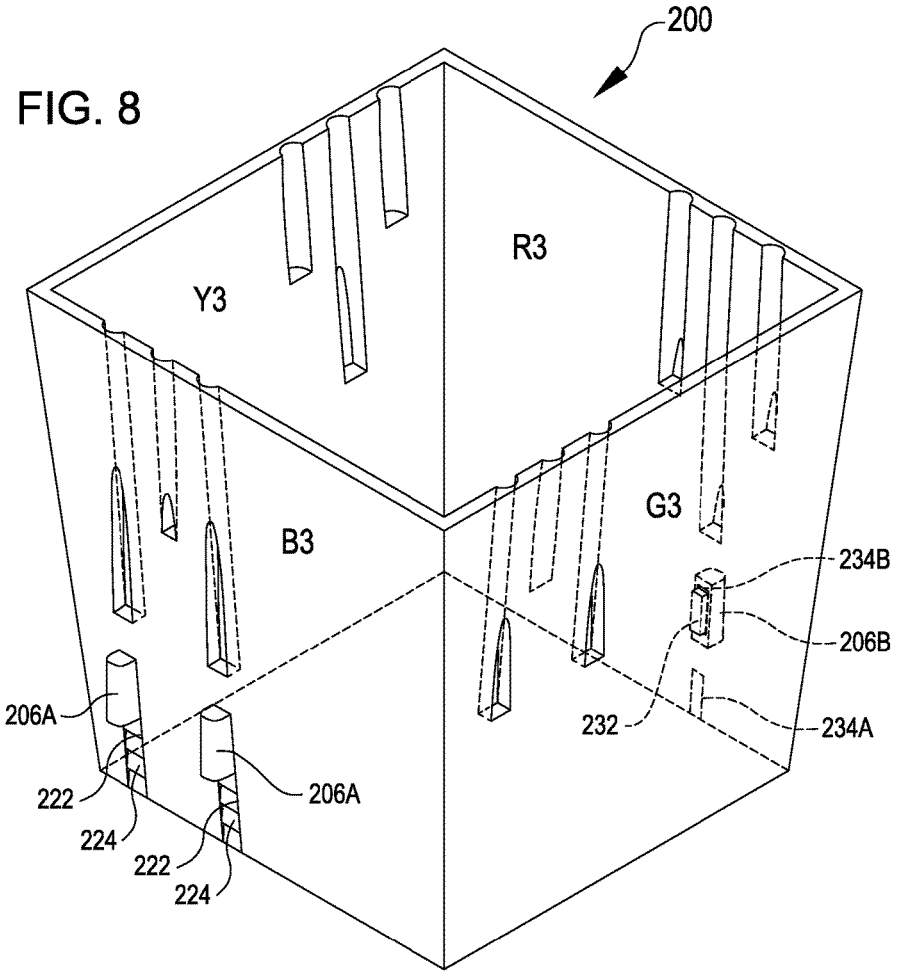
FIG. 8 illustrates another container that may be utilized with the container of FIGS. 2 and 3 according to certain embodiments.

FIG. 8 illustrates an alternative container 200 that may be used with the container 100 of FIG. 3. The alternative container 200 includes similar features to the container 100. The difference between the container 100 and the alternative container 200 in the illustrated embodiment is that the alternative container 200 includes pegs 206 that are positioned further up from the bottom of the alternative container 200 (e.g., FIG. 8) than a distance that the pegs 106 are positioned from the bottom of the container 100 (e.g., FIG. 3).

In some embodiments, such a position change may be achieved as a result of an adjustable nature of the pegs 206. For example, the pair of pegs 206A are shown respectively engaged in sliding tracks 222 (e.g., by ratcheting features 224) that can allow the pair of pegs 206A to be shifted to different heights along the height of the alternative container 200. As another example, the individual peg 206B is illustrated coupled with a support plug 232 received in a secondary socket 234B instead of in a primary socket 234A that may correspond to the position of the individual peg 106B of the container 100 shown in FIGS. 2-3. Moreover, other structures may additionally or alternatively be provided to allow the support features to be removable, retractable, extendible, or otherwise adjustable relative to the alternative container 200 and/or other containers described herein.

Figure 9:
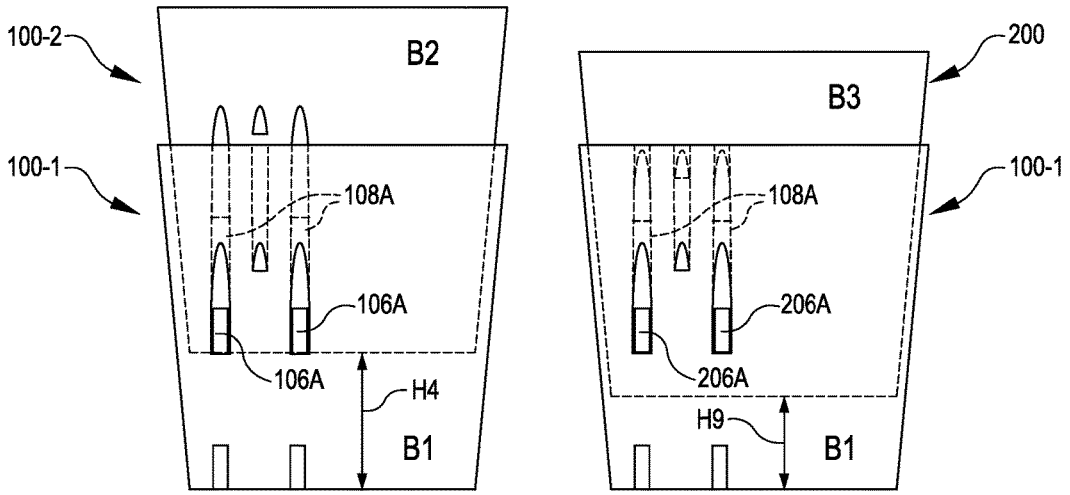
FIG. 9 illustrates different heights provided by like-nesting configurations of the container of FIG. 3 alternatively receiving another instance of the container of FIG. 3 or the container of FIG. 8.

Referring to FIG. 9, the alternative container 200 may be used with the container 100 to provide an alternate height between nesting containers in comparison to heights provided by the operation of nesting containers 100-1 and 100-2 together. For example, beginning at the right in FIG. 9, when the alternative container 200 is nested in the bottom container 100-1 in a similar orientation to the zero degree orientation of FIG. 4 (e.g., with the blue wall B3 of the alternative container 200 aligned with the blue wall B1 of the bottom container 100-1), a pair of pegs 206A of the alternative container 200 may be received at the bottom of the notches 108A to provide a different height H9 (at right in FIG. 9) than the corresponding height H4 provided by nesting the two instances or replicas 100-1 and 100-2 of the container 100 (replicated at left in FIG. 9 from at right in FIG. 4).

Other variations of the container 100 and/or alternative container 200 are also possible. For example, although the single peg 106B and the pair of pegs 106A are shown positioned on opposite walls, these or other features could be included on walls that are arranged in an adjacent or other relationship. Pegs 106 and/or notches 108 may be included on all or fewer than all of the walls, and/or on other surfaces of the container 100, such as on the bottom 104 of the container 100. Moreover, although the container 100 is depicted with pegs 106 on an exterior and notches 108 on an interior, the features could be arranged differently into combinations with at least some of the notches 108 instead on the exterior and/or with at least some of the pegs 106 on the interior. Additionally, although the notches 108 and pegs 106 that support a container in a given configuration are depicted herein at like distances from the top of the container, offset distances could also be used. In some embodiments, the distances may be offset by a sufficient amount to cause the tops of the containers to be parallel or approximately parallel to one another when nested. Although specific embodiments have been shown in the figures, aspects (e.g., the sizes, numbers, placements) of features described herein (e.g., notches or pegs) may be varied individually or in combination, yet still provide the described variable height nesting capability.

In some embodiments, support features of the container 100 and/or alternative container 200 may be associated with the bottom 104 in addition to or as alternatives to association with the walls. For example, as shown in FIG. 2, the pegs 106 may extend from the bottom 104 rather than from the walls (e.g., the pegs 106 may be positioned as shown in phantom lines about the perimeter of the bottom 104 instead of as shown in hidden lines along the walls in FIG. 2). In some embodiments, a bottom 104 may be provided with pegs 106 and without walls, for example, to function as a separator or lid that can be installed in a container 100 to engage the support features and separate sections within the container 100 from one another. The bottom 104 may include a handle 116 (e.g., formed by one or more passages 118 through a portion of the bottom 104) in some embodiments, such as to facilitate positioning, installation, and/or removal of the bottom 104 as a stand-along separator with respect to another container, such as the container 100 or alternative container 200.

Figure 10:
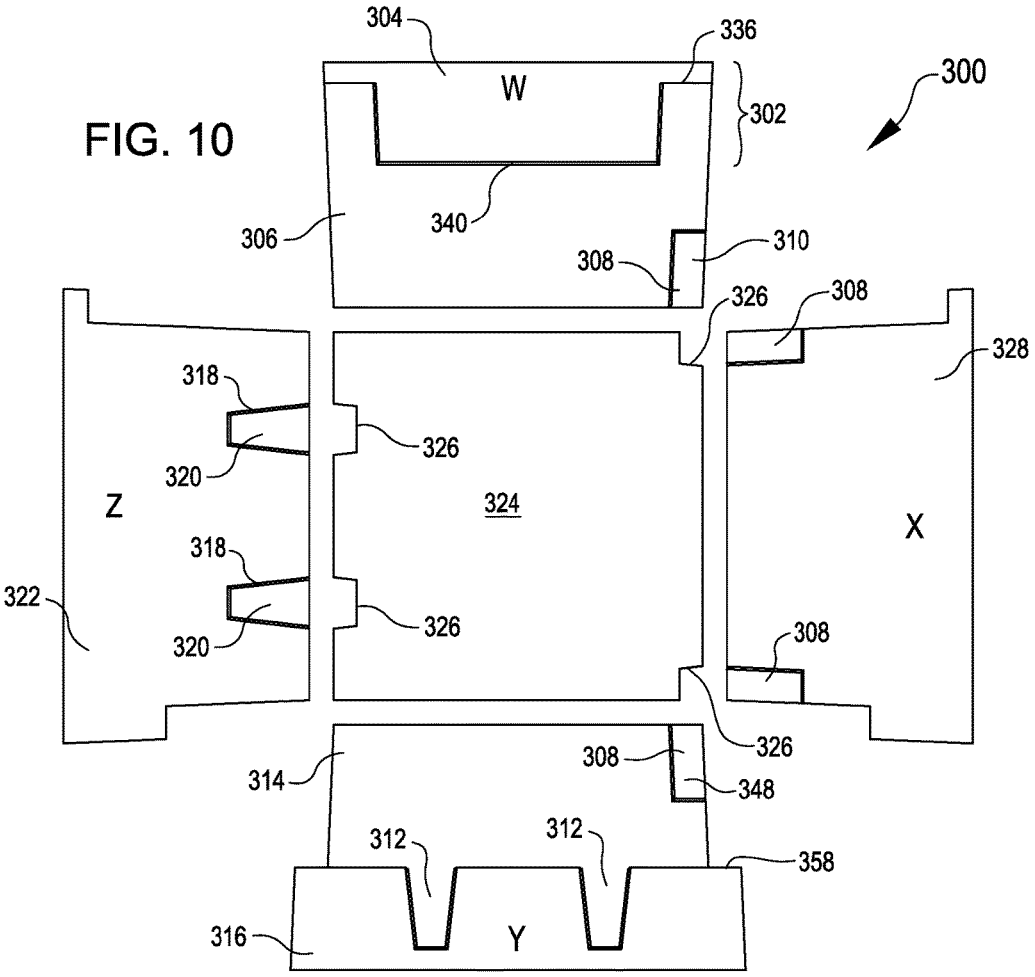
FIG. 10 illustrates another example of a container for variable height nesting, showing the walls of the container arranged in a laid-flat state according to certain embodiments.
Figure 11:
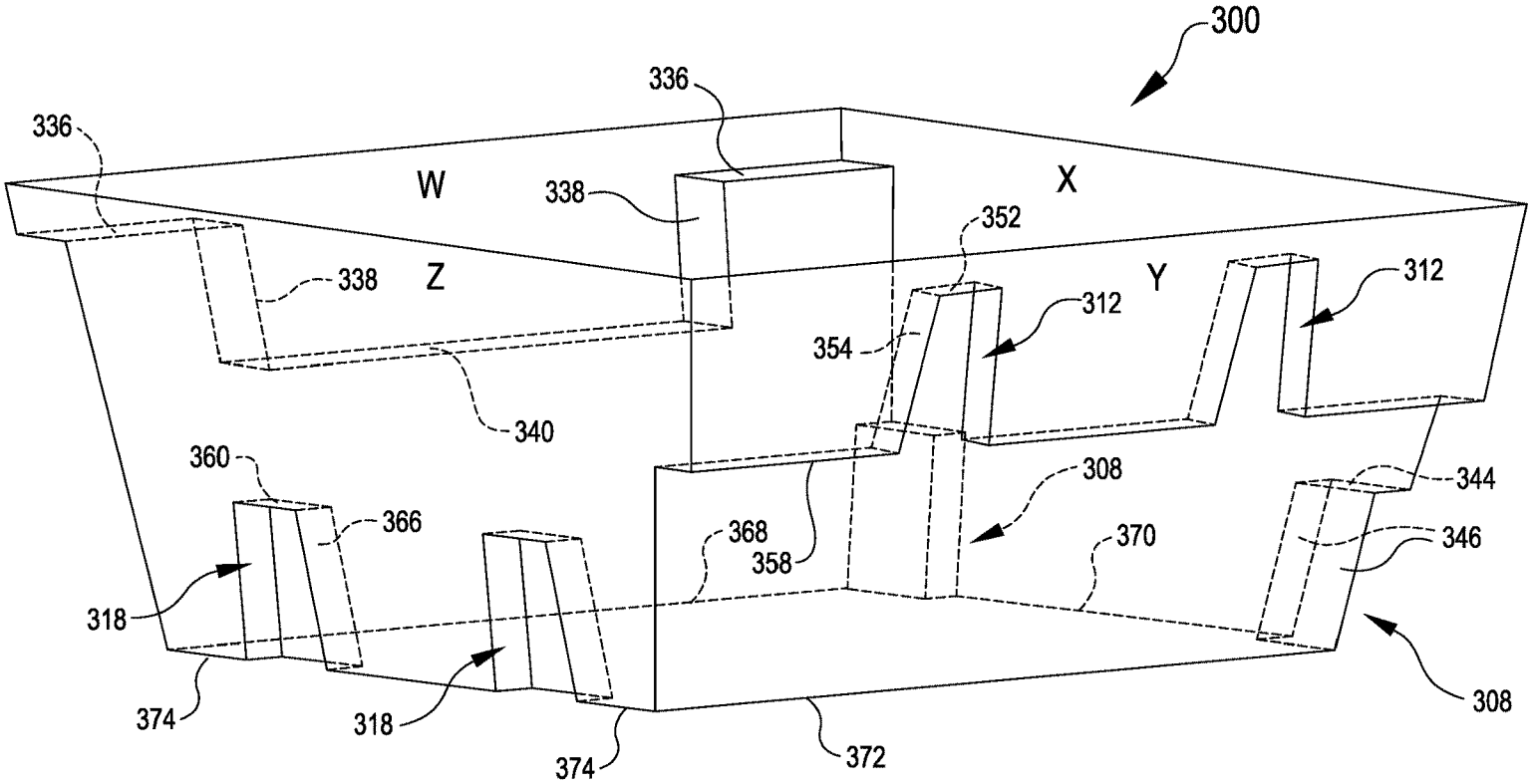
FIG. 11 illustrates a perspective view of the container of FIG. 10 in an assembled state.

Other types of containers may also be used that are examples of the containers T1 and T2 of FIG. 1. FIGS. 10-11 illustrate another container 300 that may be an example of either or both of the containers T1 or T2 of FIG. 1.

Whereas the containers 100 and 200 previously described are depicted including identical received and receiving features for the support features S (e.g., the pegs 106 and notches 108 in the previously described embodiments are all similar features with different lengths or arrangements to provide the described functionality), other embodiments are also possible. In some embodiments, a greater variety of supporting features S can be utilized. The container 300 includes support features S with such variety as one example.

The container 300 is shown in FIGS. 10-11 with respective walls W, X, Y, and Z. The walls have respective features that may be examples of the support features S from FIG. 1 and that permit different nesting or stacking heights based on different rotational alignment.

The wall W includes a staggered ridge 302. The staggered ridge 302 includes an upper ridge 336 and a lower ridge 340. The upper ridge 336 and the lower ridge 340 may each be substantially parallel to any combination of the top of the container 300, the bottom of the container 300, the top of the wall W, and/or the bottom of the wall W. The upper ridge 336 and the lower ridge 340 are separated by a ridge ramp 338. The ridge ramp 338 may be tapered to facilitate nesting with other features of the container 300. The staggered ridge 302 may be formed by a first portion 304 of the wall W that is positioned further away from a center of the container 300 (e.g., further into the page in FIG. 10) than a second portion 306 of the wall W.

The wall X includes bulges 308. The bulges 308 are positioned at lower lateral corners of the wall X. The bulges 308 extend inwardly into the container 300 and include a bulge top 344 and bulge ramps 346. The bulge ramps 346 may be tapered to facilitate nesting with other features of the container 300. The bulge tops 344 may be substantially parallel to any combination of the top of the container 300, the bottom of the container 300, the top of the wall X, and/or the bottom of the wall X.

The wall Y includes a ledge 358 and upper wedges 312. The ledge 358 may be substantially parallel to any combination of the top of the container 300, the bottom of the container 300, the top of the wall Y, and/or the bottom of the wall Y. The upper wedges 312 are shown extending upwardly from the ledge 358. The upper wedges 312 can include upper wedge ramps 354 that taper upward (e.g., from the ledge 358) to upper wedge tops 352, e.g., to facilitate nesting with other features of the container 300. The upper wedge tops 352 may be substantially parallel to any combination of the top of the container 300, the bottom of the container 300, the top of the wall Y, and/or the bottom of the wall Y. The ledge 358 and/or the upper wedges 312 may be formed by a lower portion 314 of the wall Y that extends further into the container than an upper portion 316 of the wall Y.

Although primarily described above with respect to the wall X, the bulges 308 can correspond to structure that extends into the container from any combination of the walls W, X, and Y. For example, in some cases, a main portion 328 of the wall X may have material that extends further away (e.g., into the page in FIG. 10) from the center of the container 300 in order to form at least a portion of the bulges 308. At the juncture of wall X with wall W, the bulge 308 may additionally or alternatively correspond to a section of material (e.g., a third portion 310 of the wall W) that extends further towards the center of the container 300 (e.g. out of the page in FIG. 10) than the second portion 306 of the wall W. Similarly, at the juncture of wall Y with wall X, the bulge 308 may additionally or alternatively correspond to a section of material (e.g., an inset portion 348 of the wall Y) that extends further towards the center of the container 300 (e.g., out of the page in FIG. 10) than the remainder of the lower portion 314 of the wall Y.

The wall Z can include lower wedges 318. The lower wedges 318 may include lower wedge tops 360 and lower wedge ramps 366. The lower wedge ramps 366 may taper upward, e.g., to facilitate nesting with other features of the container 300. The lower wedge tops 360 may be substantially parallel to any combination of the top of the container 300, the bottom of the container 300, the top of the wall Z, and/or the bottom of the wall Z. The lower wedges 318 may be formed for example by portions 320 at the lower end of the wall Z that extends further into the container 300 (e.g., out of the page in FIG. 10) than an upper portion 322 of the wall Z.

The walls W, X, Y, and Z of the container 300 can be joined together along a floor 324 of the container 100. Respective edges of the floor 324 may correspond to at least the lower edge 368 of wall W, a lower central edge 370 of wall X, the lower edge 372 of wall Y, and the lower lateral edges 374 of wall Z. The floor 324 may include indentations 326 along the perimeter, for example, where features of the walls extend inward towards the center of the container 300. For example, some indentations 326 may be formed where the lower wedges 318 on the wall Z meet the floor 324, and some indentations 326 may be positioned where the bulges 308 extend in from the wall X and/or the walls W and Y.

Figure 12:
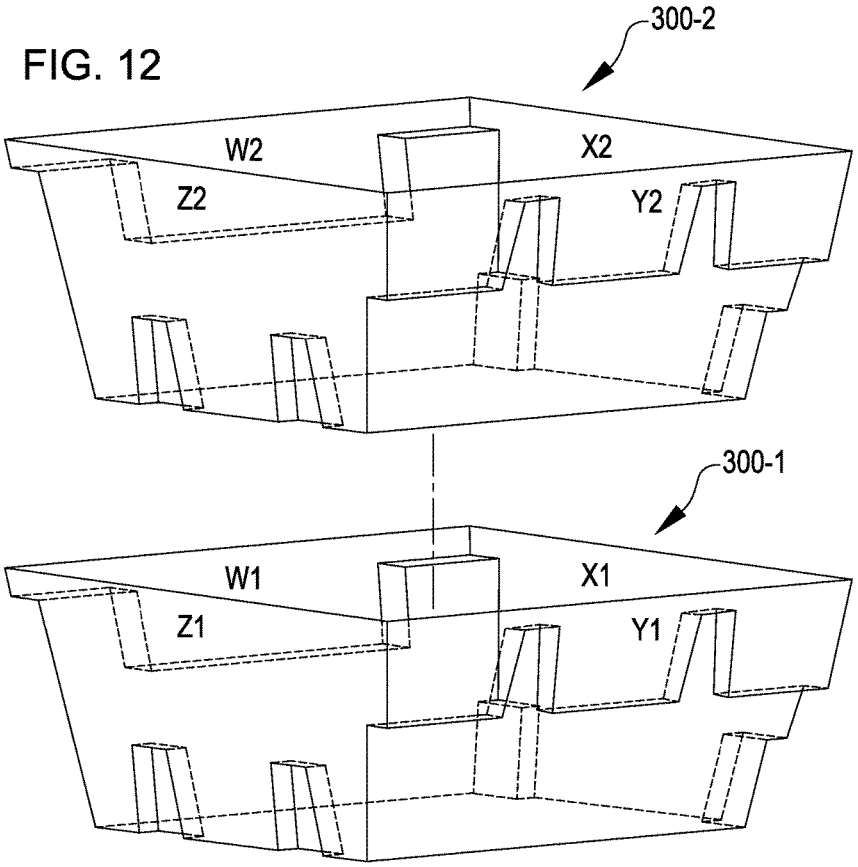
FIG. 12 illustrates first and second instances of the container of FIGS. 10 and 11 aligned for nesting in a first configuration.

Turning to FIG. 12, a first and second replica of the container 300 may be aligned for nesting together in a particular configuration. FIG. 12 respectively references the replicas of the container 300 as a bottom or first container 300-1 and a top or second container 300-2. Walls of the bottom container 300-1 are identified with the suffix "1" (e.g., W1, X1, Y1, Z1), while walls of the top container 300-2 are identified with the suffix "2" (e.g., W2, X2, Y2, Z2).

Figure 13:
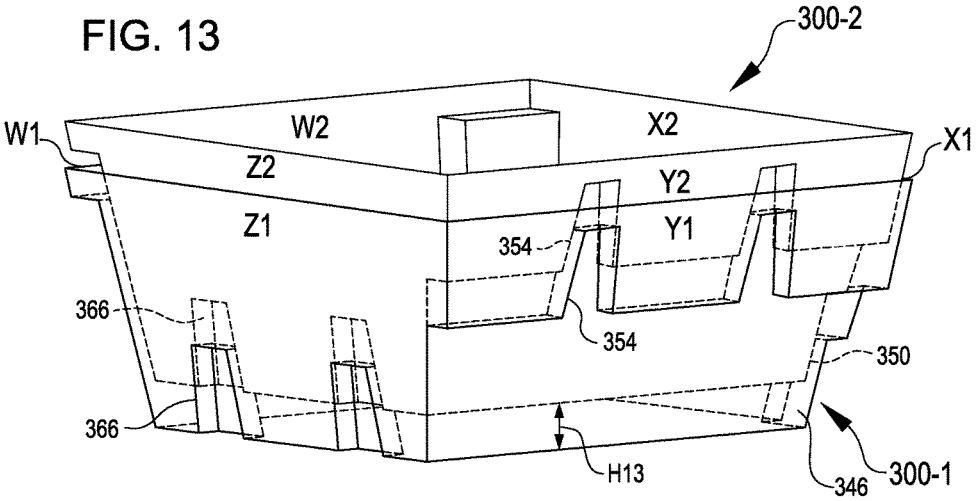
FIG. 13 illustrates the containers of FIG. 12 nested in the first configuration.

FIG. 13 shows the containers 300 nested together in one configuration. This configuration provides a height H13 between the two containers 300. For ease of reference, the arrangement shown in FIG. 13 will be referred to as a "zero degree" orientation, from which other alignments of the containers 300 may be reckoned.

In the configuration shown in FIG. 13, the exterior of the lower wedge ramp 366 of the upper container wall Z2 is received along the interior of the lower wedge ramp 366 of the lower container wall Z1. Additionally, the interior of the upper wedge ramp 354 on the lower container wall Y1 receives the exterior surface of the upper wedge ramp 354 of the upper container wall Y2. Similarly, an exterior of the bulge ramp 346 on the upper container wall X2 is received along the interior of the bulge ramp 346 of lower container wall X1. Furthermore, although somewhat obscured in FIG. 13, the exterior of the staggered ridge 302 on the upper container wall W2 is received along an interior of the staggered ridge 302 of the lower container wall W1.

The containers 300 can be shifted away from the configuration of FIG. 13 and into other configurations. For example, the upper container 300-2 may be lifted away from the configuration of FIG. 13 (e.g., into the position of FIG. 12), rotated, and then lowered into one of the positions shown in FIGS. 14-16.

Figure 14:
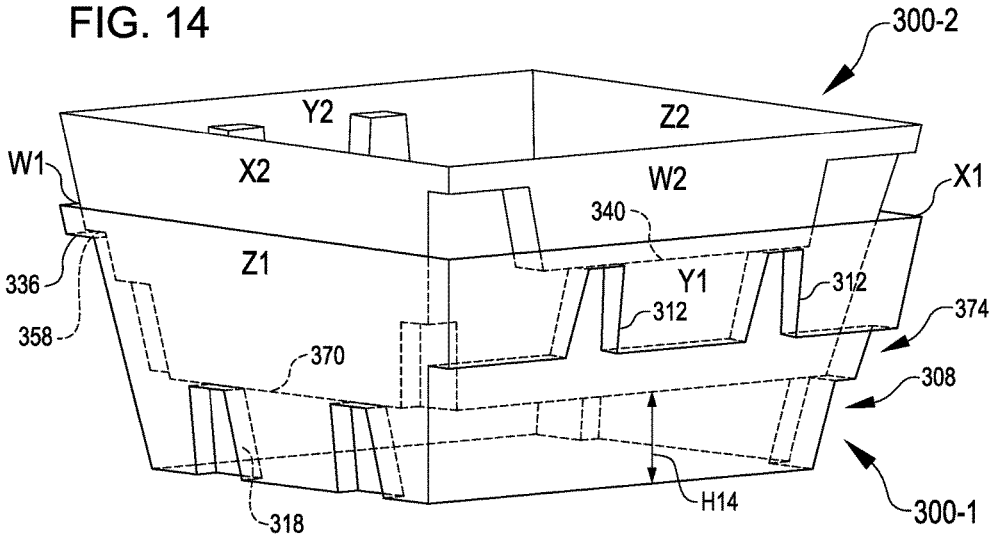
FIG. 14 illustrates the containers of FIG. 12 nested in a second configuration.

FIG. 14 illustrates the containers 300 nested together in another configuration. This configuration may correspond to a 180 degree turn from the zero degree orientation of FIG. 13. In the configuration depicted in FIG. 14, the lower central edge 370 of wall X2 of the upper container 300-2 is received on top of the lower wedges 318 of the wall Z1 of the lower container. Furthermore, the exterior of the lower ridge 340 of the wall W2 is received on top of the upper wedges 312 of the wall Y1. Although obscured from view to some degree, the lower lateral edges 374 of wall Z2 may be supported atop the bulges 308 along wall X1. Additionally, in this configuration, the wall Y2 may be supported relative to the wall W1 by the ledge 358 of wall Y2 being supported on the upper ridge 336 of wall W1. This configuration provides a height H14 that is greater than the height H13.

Figure 15:
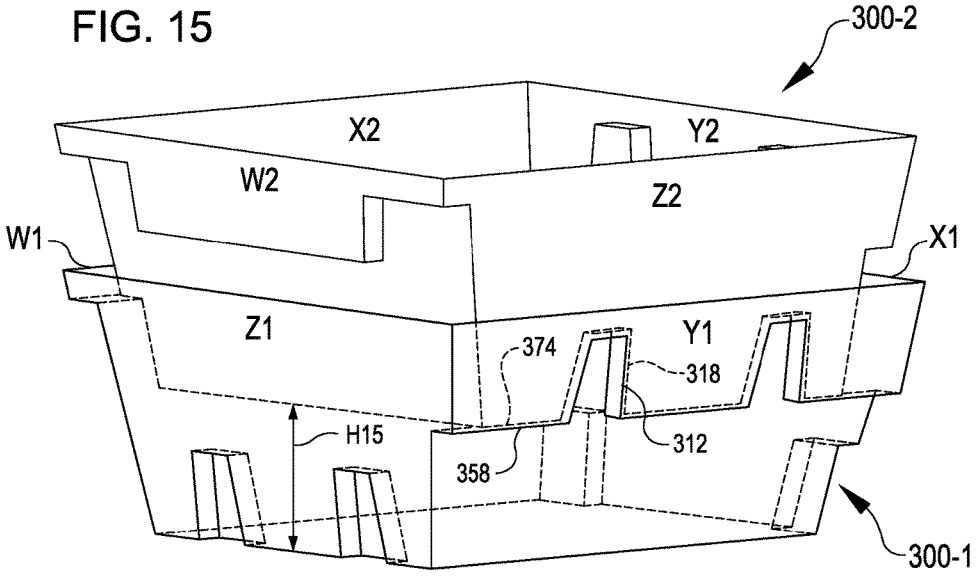
FIG. 15 illustrates the containers of FIG. 12 nested in a third configuration.

FIG. 15 illustrates another configuration of the containers 300. This configuration may correspond to a 90 degree counter-clockwise turn (or a 270 degree clockwise turn) from the zero degree orientation of FIG. 13. In the configuration depicted in FIG. 15, the lower wedges 318 on the wall Z2 are received on the upper wedges 312 of the wall Y1. The upper wedges 312 may be sufficiently sized to receive the lower wedges 318 fully thereon so that the tops 352 and 360 of the respective wedges 312 and 318 approximately abut. In alternative aspects, the wedges 312 and 318 may mate in such a way that the ramps 354 and 366 on the sides of the wedges 312 and 318 prevent the tops 352 and 360 of the wedges 312 and 318 from coming into close contact, close proximity, or abutting engagement. The wall Z2 may additionally or alternatively be supported by the lower lateral edges 374 of the wall Z2 being supported along the ledge 358 of the lower wall Y1. Although somewhat obscured from view in FIG. 15, the wall X2 of the upper container can be received so that the lower central edge 370 of the wall X2 is received along the lower ridge 340 of wall W1 and/or so that the bulges 308 of the wall X2 are received along ridge ramps 338 and/or upper ridge 336 of wall W1. Moreover, the wall Y2 of the upper container 300-2 may be suspended above features of the wall X1 of the lower container 300-1, and the wall W2 of the top container 300-2 may be suspended above features of the wall Z1 of the lower container 300-1. Accordingly, the walls X2 and Z2 of the upper container 300-2 may be the only points of contact for supporting the upper container 300-2 relative to the lower container 300-1. The configuration of FIG. 15 may cause the containers to be separated by a height H15 that is different from the other heights of the different configurations.

Figure 16:
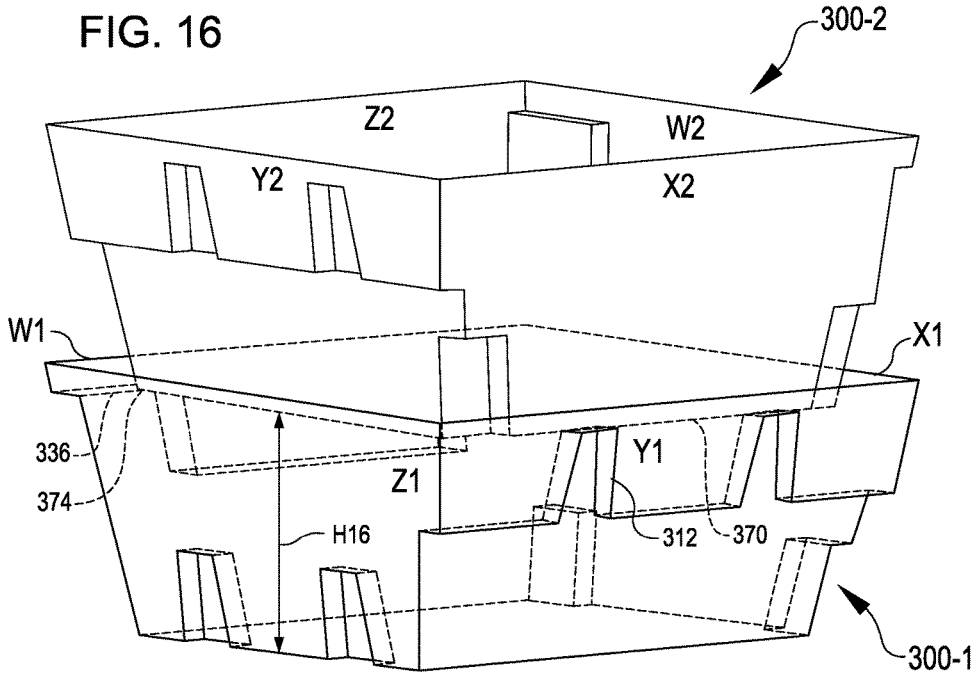
FIG. 16 illustrates the containers of FIG. 12 nested in a fourth configuration.

FIG. 16 illustrates the containers in yet another configuration. This configuration may correspond to a 270 degree counter-clockwise turn (or a 90 degree clockwise turn) from the zero degree orientation of FIG. 13. In the configuration depicted in FIG. 16, the wall X2 is supported along a lower central edge 370 by the upper wedges 312 of the lower container wall Y1. At an opposite end of the container, the wall Z2 is supported by the lower lateral edges 374 of wall Z2 engaging the upper ridge 336 of wall W1. The walls Y2 and W2 are suspended without contacting the support features of walls Z1 and X1. This configuration of FIG. 16 provides a height H16 that is different (and greater) than any of the other heights from the other configurations depicted herein for the containers 300.

Based at least in part on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this disclosure are described herein, including the best mode known to the inventors for carrying out the invention. Variations of those preferred embodiments may become apparent to those of ordinary skill in the art upon reading the foregoing description. The inventors expect skilled artisans to employ such variations as appropriate and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications and patents, cited herein are hereby incorporated by reference to the same extent as if each reference were individually and specifically indicated to be incorporated by reference and were set forth in its entirety herein.

What is claimed is:

1. A container, comprising:

a body comprising a plurality of sidewalls coupled with a bottom, the plurality of sidewalls comprising at least a first sidewall, the body further comprising an upper rim formed by uppermost peripheries of the sidewalls, the uppermost peripheries of the sidewalls having the same height along an entirety of the upper rim, the body further comprising an interior and an exterior; and support features comprising:

first support features arranged along the exterior of the body; and second support features arranged along the interior of the body, the first support features and the second support features arranged relative to one another such that the container is configured to nest within a replica of the container in at least:

a first configuration in which (a) the first sidewall of the container is oriented relative to the first sidewall of the replica in a first rotational alignment, and (b) the bottom of the container and the bottom of the replica are separated by a first distance by engagement of at least some of the support features of the container with at least some of the support features of the replica;

a second configuration in which (a) the first sidewall of the container is oriented relative to the first sidewall of the replica in a second rotational alignment different from the first rotational alignment, and (b) the bottom of the container and the bottom of the replica are separated by a second distance by engagement of at least some of the support features of the container with at least some of the support features of the replica, the second distance being different from the first distance;

a third configuration in which (a) the first sidewall of the container is oriented relative to the first sidewall of the replica in a third rotational alignment different from the first rotational alignment and the second rotational alignment, and (b) the bottom of the container and the bottom of the replica are separated by a third distance by engagement of at least some of the support features of the container with at least some of the support features of the replica, the third distance being different from the first distance and the second distance; and a fourth configuration in which (a) the first sidewall of the container is oriented relative to the first sidewall of the replica in a fourth rotational alignment different from the first rotational alignment, the second rotational alignment, and the third rotational alignment, and (b) the bottom of the container and the bottom of the replica are separated by a fourth distance by engagement of at least some of the support features of the container with at least some of the support features of the replica, the fourth distance being different from the first distance, the second distance, and the third distance.

2. The container of claim 1, wherein the upper rim has a profile resembling a square, and wherein the plurality of sidewalls comprises at least the first sidewall, a second sidewall, a third sidewall, and a fourth sidewall all extending upward from the bottom and having a same height.

3. The container of claim 1, wherein the plurality of sidewalls comprises the first sidewall, a second sidewall, a third sidewall, and a fourth sidewall;

wherein the first support features comprise:

a lower exterior wedge-shaped recess extending inward from an exterior lower portion of the first sidewall;

a first lower edge of the first sidewall;

an exterior bulge-shaped recess extending inward from an exterior lower portion of the second sidewall; and a second lower edge of the second sidewall;

wherein the second support features comprise:

a lower interior wedge extending inward from an interior lower portion of the first sidewall;

an interior bulge extending inward from an interior lower portion of the second sidewall;

an upper interior wedge extending inward from an interior upper portion of the third sidewall; and an upper staggered ridge extending inward from an interior upper portion of the fourth sidewall, the staggered ridge including an upper ridge and a lower ridge;

wherein the bottom of the container and the bottom of the replica are separated by the first distance in the first configuration as a result of the lower exterior wedge-shaped recess of the container being received by the lower interior wedge of the replica and the exterior bulge-shaped recess of the container being received by the interior bulge of the replica;

wherein the bottom of the container and the bottom of the replica are separated by the second distance in the second configuration as a result of the second lower edge of the container being received by the lower interior wedge of the replica and the first lower edge of the container being received by the interior bulge of the replica;

wherein the bottom of the container and the bottom of the replica are separated by the third distance in the third configuration as a result of the lower exterior wedge-shaped recess of the container being received by the upper interior wedge of the replica and the exterior bulge-shaped recess of the container being received by the staggered ridge of the replica, and wherein the bottom of the container and the bottom of the replica are separated by the fourth distance in the fourth configuration as a result of the second lower edge of the container being received by the upper interior wedge of the replica and the first lower edge of the container being received by the staggered ridge of the replica.

4. A container, comprising:

a body comprising a plurality of sidewalls coupled with a bottom, the plurality of sidewalls comprising at least a first sidewall, a second sidewall, a third sidewall, and a fourth sidewall all extending upward from the bottom and having a same height, the body further comprising an upper rim having a profile resembling a square and formed by uppermost peripheries of the sidewalls, the uppermost peripheries of the sidewalls having the same height along an entirety of the upper rim, the body further comprising an interior and an exterior; and support features comprising:

first support features arranged along the exterior of the body; and second support features arranged along the interior of the body, the first support features and the second support features arranged relative to one another such that the container is configured to nest within a replica of the container in at least:

a first configuration in which (a) the first sidewall of the container is oriented relative to the first sidewall of the replica in a first rotational alignment, and (b) the bottom of the container and the bottom of the replica are separated by a first distance by engagement of at least some of the support features of the container with at least some of the support features of the replica;

a second configuration in which (a) the first sidewall of the container is oriented relative to the first sidewall of the replica in a second rotational alignment different from the first rotational alignment, and (b) the bottom of the container and the bottom of the replica are separated by a second distance by engagement of at least some of the support features of the container with at least some of the support features of the replica, the second distance being different from the first distance;

a third configuration in which (a) the first sidewall of the container is oriented relative to the first sidewall of the replica in a third rotational alignment different from the first rotational alignment and the second rotational alignment, and (b) the bottom of the container and the bottom of the replica are separated by a third distance by engagement of at least some of the support features of the container with at least some of the support features of the replica, the third distance being different from the first distance and the second distance; and a fourth configuration in which (a) the first sidewall of the container is oriented relative to the first sidewall of the replica in a fourth rotational alignment different from the first rotational alignment, the second rotational alignment, and the third rotational alignment, and (b) the bottom of the container and the bottom of the replica are separated by a fourth distance different from the first distance, the second distance, and the third distance.

5. The container of claim 4, wherein the container comprises a particular total number of sidewalls, wherein the container is configured to nest with the replica in a particular number of configurations equal to the particular total number of sidewalls, each of the particular number of configurations associated with a corresponding unique distance separating the bottom of the container and the bottom of the replica.

6. The container of claim 4, wherein the support features comprise notches of different lengths configured to alternatively receive a peg at different distances relative to the bottom of the container.

7. The container of claim 4, wherein the second support features comprise at least one of bulges or wedges.

8. The container of claim 4, wherein the first support features comprise at least one ridge or ledge formed along an exterior of the body.

9. The container of claim 4, wherein the support features comprise at least one ramped surface.

10. The container of claim 4, wherein the first support features comprise:

a lower exterior wedge-shaped recess extending inward from an exterior lower portion of the first sidewall;

a first lower edge of the first sidewall;

an exterior bulge-shaped recess extending inward from an exterior lower portion of the second sidewall; and a second lower edge of the second sidewall;

wherein the second support features comprise:

a lower interior wedge extending inward from an interior lower portion of the first sidewall;

an interior bulge extending inward from an interior lower portion of the second sidewall;

an upper interior wedge extending inward from an interior upper portion of the third sidewall; and an upper staggered ridge extending inward from an interior upper portion of the fourth sidewall, the staggered ridge including an upper ridge and a lower ridge;

wherein the bottom of the container and the bottom of the replica are separated by the first distance in the first configuration as a result of the lower exterior wedge-shaped recess of the container being received by the lower interior wedge of the replica and the exterior bulge-shaped recess of the container being received by the interior bulge of the replica;

wherein the bottom of the container and the bottom of the replica are separated by the second distance in the second configuration as a result of the second lower edge of the container being received by the lower interior wedge of the replica and the first lower edge of the container being received by the interior bulge of the replica;

wherein the bottom of the container and the bottom of the replica are separated by the third distance in the third configuration as a result of the lower exterior wedge-shaped recess of the container being received by the upper interior wedge of the replica and the exterior bulge-shaped recess of the container being received by the staggered ridge of the replica; and wherein the bottom of the container and the bottom of the replica are separated by the fourth distance as a result of the second lower edge of the container being received by the upper interior wedge of the replica and the first lower edge of the container being received by the staggered ridge of the replica.

11. An assembly, comprising:

a primary container comprising a primary body comprising (a) primary support features comprising primary first support features arranged along a primary exterior of the primary container and primary second support features arranged along a primary interior of the primary container, (b) a primary bottom, (c) primary sidewalls comprising at least a primary first sidewall, a primary second sidewall, a primary third sidewall, and a primary fourth sidewall all coupled with and extending upward from the primary bottom and all having a same primary height, and (d) a primary upper rim having a primary square profile and formed by uppermost peripheries of the primary sidewalls, the uppermost peripheries of the primary sidewalls having the same primary height along an entirety of the primary upper rim;

a secondary container that is a replica of the first container and comprises a secondary body comprising (a) secondary support features comprising secondary first support features arranged along a secondary exterior of the secondary container and secondary second support features arranged along a secondary interior of the secondary container, (b) a secondary bottom, (c) secondary sidewalls comprising at least a secondary first wall, a secondary second sidewall, a secondary third wall, and a secondary fourth wall all coupled with and extending upward from the secondary bottom and all having a same secondary height and (d) a secondary upper rim having a secondary square profile and formed by uppermost peripheries of the secondary sidewalls, the uppermost peripheries of the secondary sidewalls having the same secondary height along an entirety of the secondary upper rim;

wherein the primary container is configured to nest within the secondary container in at least:

a first configuration in which (a) the primary first sidewall is oriented relative to the secondary second sidewall in a first rotational alignment, and (b) the primary first support features are supported by the secondary second support features such that the primary bottom is positioned relative to the secondary bottom at a first distance;

a second configuration in which (a) the primary first sidewall is oriented relative to the secondary second sidewall in a second rotational alignment different from the first rotational alignment, and (b) the primary first support features are supported by the secondary second support features such that the primary bottom is positioned relative to the secondary bottom at a second distance different from the first distance;

a third configuration in which (a) the primary first sidewall is oriented relative to the secondary second sidewall in a third rotational alignment different from the first rotational alignment and the second rotational alignment, and (b) the primary first support features are supported by the secondary second support features such that the primary bottom is positioned relative to the secondary bottom at a third distance different from the first distance and the second distance; and a fourth configuration in which (a) the primary first sidewall is oriented relative to the secondary second sidewall in a fourth rotational alignment different from the first rotational alignment, the second rotational alignment, and the third rotational alignment, and (b) the primary first support features are supported by the secondary second support features such that the primary bottom is positioned relative to the secondary bottom at a fourth distance different from the first distance, the second distance, and the third distance.

12. The assembly of claim 11, wherein tops of the primary container and the secondary container are positioned parallel to one another in each of the first configuration, the second configuration, and the third configuration.

13. The assembly of claim 11, further comprising a third container comprising:

(a) a third bottom;

(b) a third first sidewall; and (c) third support features arranged along an exterior of the third container;

wherein the third container is configured to nest within the second container in a fifth configuration in which (a) the third first sidewall is oriented relative to the secondary second sidewall in the first rotational alignment, and (b) the third support features are supported by the second support features such that the third bottom is positioned relative to the secondary bottom at a fifth distance different from the first distance.

14. The assembly of claim 13, wherein the third container is further configured to nest within the secondary container in a sixth configuration in which (a) the third first sidewall is oriented relative to the secondary second sidewall in another rotational alignment different from the first rotational alignment, and (b) the third support features are supported by the secondary support features such that the third bottom is positioned relative to the secondary bottom at a sixth distance different from the fifth distance.

15. The assembly of claim 11, wherein the primary container and the secondary container each include a particular total number of sidewalls, wherein the primary container is configured to nest within the secondary container in a particular total number of configurations, each of the particular total number of configurations corresponding to (a) a different rotational alignment between the primary first sidewall and the secondary second sidewall, and (b) a different distance between the primary bottom and the secondary bottom.

16. The assembly of claim 11, further comprising a separator comprising a separator body and a set of the first support features arranged along an exterior of the separator body, the separator configured to be received within the secondary container in a plurality of configurations corresponding to different rotational alignments of the separator, each of the plurality of configurations causing the set of the first support features of the separator to engage the secondary second support features differently so as to support the separator at different distances relative to the secondary bottom.

17. The assembly of claim 11, wherein at least one of:

at least one of the first support features is configured to be at least one of adjustable or removable relative to the primary container; or at least one of the second support features is configured to be at least one of adjustable or removable relative to the secondary container.

18. A method, comprising:

nesting a primary container within a secondary container in a first configuration, the secondary container being a replica of the first container, the primary container comprising a primary body comprising (a) a primary bottom, (b) primary sidewalls comprising at least a primary first sidewall, a primary second sidewall, a primary third sidewall, and a primary fourth sidewall all coupled with and extending upward from the primary bottom and all having a same primary height; (c) primary support features comprising primary first support features arranged along a primary exterior of the primary container and primary second support features arranged along a primary interior of the primary container, (d) a primary reference face comprising a surface of at least one of the primary sidewalls, and (e) a primary upper rim having a primary square profile and formed by uppermost peripheries of the primary sidewalls, the uppermost peripheries of the primary sidewalls having the same primary height along an entirety of the primary upper rim, and the secondary container comprising a secondary body comprising (a) a secondary bottom, (b) secondary sidewalls comprising at least a secondary first sidewall, a secondary second sidewall, a secondary third sidewall, and a secondary fourth sidewall all coupled with and extending upward from the secondary bottom and all having a same secondary height (c) secondary support features comprising secondary first support features arranged along a secondary exterior of the secondary container and secondary second support features arranged along a secondary interior of the secondary container, (d) a secondary reference face comprising a surface of at least one of the secondary sidewalls, and (e) a secondary upper rim having a secondary square profile and formed by uppermost peripheries of the secondary sidewalls, the uppermost peripheries of the secondary sidewalls having the same secondary height along an entirety of the secondary upper rim, wherein in the first configuration (a) the primary reference face is oriented relative to the secondary reference face in a first rotational alignment, and (b) the primary first support features are supported by the secondary second support features such that the primary bottom is positioned above the secondary bottom at a first height;

changing a height between the primary bottom and the secondary bottom by re-nesting the primary container within the secondary container in a second configuration, wherein in the second configuration (a) the primary reference face is oriented relative to the secondary reference face in a second rotational alignment in which at least one of the primary reference face or the secondary reference face is rotated relative to the first rotational alignment, and (b) the primary first support features are supported differently by the secondary second support features than in the first configuration such that the primary bottom is positioned above the secondary bottom at a second height different from the first height;

further changing the height between the primary bottom and the secondary bottom by further re-nesting the primary container within the secondary container in a third configuration, wherein in the third configuration (a) the primary reference face is oriented relative to the secondary reference face in a third rotational alignment in which at least one of the primary reference face or the secondary reference face is rotated relative to the first rotational alignment and the second rotational alignment, and (b) the primary first support features are supported differently by the secondary second support features than in the first configuration and the second configuration such that the primary bottom is positioned above the secondary bottom at a third height different from the first and second heights;

further changing the height between the primary bottom and the secondary bottom by further re-nesting the primary container within the secondary container in a fourth configuration, wherein in the fourth configuration (a) the primary reference face is oriented relative to the secondary reference face in a fourth rotational alignment in which at least one of the primary reference face or the secondary reference face is rotated relative to the first rotational alignment, the second rotational alignment, and the third rotational alignment, and (b) the primary first support features are supported differently by the secondary second support features than in the first configuration, the second configuration, and the third configuration such that the primary bottom is positioned above the secondary bottom at a fourth height different from the first, second, and third heights.

19. The method of claim 18, wherein a primary top of the primary container and a secondary top of the secondary container are positioned parallel to one another when the primary container is nested in the secondary container.

20. The method of claim 18, wherein the primary sidewalls are arranged relative to one another such that a cross-sectional shape of the primary container corresponds to a polygon, wherein the secondary sidewalls are arranged relative to one another such that a cross-sectional shape of the secondary container corresponds to the same polygon, and wherein the primary sidewalls and the secondary sidewalls each extend along each other and along a side of the polygon in each of the first configuration, the second configuration, and the third configuration.

* * * * *